US005091748A

United States Patent [19]

Morisawa et al.

[11] Patent Number: 5,091,748

[45] Date of Patent: Feb. 25, 1992

[54] TONER SUPPLYING MECHANISM

[75] Inventors: Satoru Morisawa, Kita; Tsutomu Sato, Tokyo, both of Japan

[73] Assignee: Asahi Kogku Kogyo Kabushiki Kaisha, Tokyo, Japan

[21] Appl. No.: 683,344

[22] Filed: Apr. 10, 1991

[30] Foreign Application Priority Data

Apr. 10, 1990 [JP] Japan ..... 2-94423

[51] Int. Cl.[5] ..... G03G 15/08

[52] U.S. Cl. ..... 355/245; 355/253; 118/656

[58] Field of Search ..... 118/656, 657, 658, 653; 355/245, 251, 252, 253, 260; 430/120, 122

[56] References Cited

U.S. PATENT DOCUMENTS

| | | | |
|---|---|---|---|
| 4,044,719 | 8/1977 | Ohmori | 118/652 |
| 4,422,750 | 12/1983 | Kawata et al. | 118/657 X |
| 4,436,055 | 3/1984 | Yamashita et al. | 118/658 |
| 4,457,257 | 7/1984 | Marakami et al. | 118/652 X |
| 4,572,631 | 2/1986 | Kondo | 118/658 X |
| 4,632,535 | 12/1986 | Nagata | 118/656 X |
| 4,792,225 | 12/1988 | Itaya | 118/657 X |
| 4,881,103 | 11/1989 | Seto et al. | 355/251 |
| 4,893,151 | 1/1990 | Yamazaki et al. | 355/245 |
| 4,947,200 | 8/1990 | Kumasaka et al. | 355/251 |
| 4,967,691 | 11/1990 | Chikama et al. | 118/656 |
| 5,003,917 | 4/1991 | Toyoshi et al. | 118/653 |

FOREIGN PATENT DOCUMENTS

| | | |
|---|---|---|
| 0166873 | 1/1986 | European Pat. Off. . |
| 2148152 | 5/1985 | United Kingdom . |

*Primary Examiner*—R. L. Moses

*Attorney, Agent, or Firm*—Sandler, Greenblum, & Bernstein

[57] ABSTRACT

A toner supplying mechanism for use in an imaging apparatus for forming a toner image. The development unit of the apparatus includes a development roller for attracting toner particles to be adhered onto a circumferential surface of a predetermined material. The toner cartridge member, provided at the upper side of the development roller, houses a multiplicity of toner particles to be supplied toward the development roller through an inclined inner wall of the development unit. A scraper member, having at least one rotating arm member on a predetermned shaft member, located between the development roller and the toner cartridge, scrapes the toner particles on the inner wall and feeds them toward the development roller. The development unit further includes an elastic sheet member, located on the inclined inner wall, whose lower edge portion is arranged to be flipped by the rotating arm member. The upper edge portion of the elastic sheet member is fixed to the inclined inner wall. Thus, it becomes possible to effectively supply toner from the toner cartridge toward the development roller.

9 Claims, 4 Drawing Sheets

TONER SUPPLYING MECHANISM

BACKGROUND OF THE INVENTION

This invention relates to a toner supplying mechanism for a development unit including a development roller adapted to be positioned in an imaging apparatus such as a printer employing a so-called electrophotographic system so that toner particles are effectively supplied to the development roller.

Conventionally, known are imaging apparatuses such as an electric copying machine, a laser beam printer and the like capable of forming a visible image on a recording medium through a so-called electrophotographic system, wherein a photoconductive drum whose circumferential surface is covered with a photoconductive material layer is evenly charged with a predetermined polarity and exposed to light in accordance with image data for forming a latent image, toner particles are adhered to the surface of the photoconductive drum for making the latent image visible, the visible toner image is transferred to a recording medium such as a continuous-form recording sheet, and finally, the recording medium is subjected to pressure and high temperature so that the transferred image is fixed on the recording medium.

In this type of imaging apparatus, recently, each of the processes has been improved so as to be executed at high speed. Further, in view of the so-called space factor, it has become desirable to make the imaging apparatus small in size.

Further, in view of the high speed image forming operation, once the toner is supplied, it becomes preferable to execute the image forming operation as long as possible without an additional toner supplying operation.

In the development unit employed in the electrophotographic system, toner particles having been accommodated within a toner accommodating part thereof are attracted by magnetic force generated by a development roller which is located at a development portion at which a developing operation is to be executed. At the upper side of the toner accommodating part, a toner cartridge can be detachably provided. The toner cartridge, in which toner particles are housed is attached to the development unit, and the toner particles are supplied to the toner accommodating part from the toner cartridge.

In the toner accommodating part, a toner scraper comprises a plurality of arm members respectively connected to a shaft member which is arranged to be rotated. The toner particles having been supplied to the toner accommodating part are fed toward the development roller by means of the rotating arms. Accordingly, it is preferable to supply the toner particles within the arm rotating area of the arm members.

As described above, it is preferable to execute the image forming operation without the additional toner supplying operation and accordingly, it becomes preferable to make the toner accommodating part as large in volume as possible. However, since it is also preferable to make the whole volume of the imaging apparatus small, an inner wall of the accommodating part for connecting the toner cartridge and the toner accommodating part is usually formed in an inclined state so that the toner particles are fed toward the development roller by taking advantage of their fluidity. Therefore, the height of the imaging apparatus is made shorter as compared with the case in which the toner cartridge is located just over the toner scraper.

However; recently, since it has become desirable to make the imaging apparatus been even smaller, the outer form of the toner accommodating part is further limited, and the inclined angle of the inner wall often can not be designated for an effective supplying operation of the toner particles. In this case, a problem arises in that the toner particles remain on the inclined wall surface and are not fed toward the development roller.

SUMMARY OF THE INVENTION

It is therefore an object of the invention to provide an improved toner supplying mechanism for supplying toner particles from the toner cartridge to the development roller.

For this purpose, according to the present invention, there is provided a development unit, adapted to be positioned in an imaging apparatus for forming a toner image, comprising a development roller for attracting toner particles to be adhered onto a circumferential surface of a predetermined material, toner cartridge member provided at the upper side of the development roller for housing a multiplicity of toner particles to be supplied toward the development roller through an inclined inner wall of the development unit, and a scraper member, having at least one rotating arm member on a predetermined shaft member, located between the development roller and the toner cartridge for scraping the toner particles on the inner wall and feeding them toward the development roller;

the development unit further including an elastic sheet member, located on the inclined inner wall, whose lower edge portion is arranged to be arranged to be flipped by the rotating arm member, while an upper edge portion is fixed to the inclined inner wall.

DESCRIPTION OF THE ACCOMPANYING DRAWINGS

DESCRIPTION OF THE EMBODIMENTS

Figure 1:
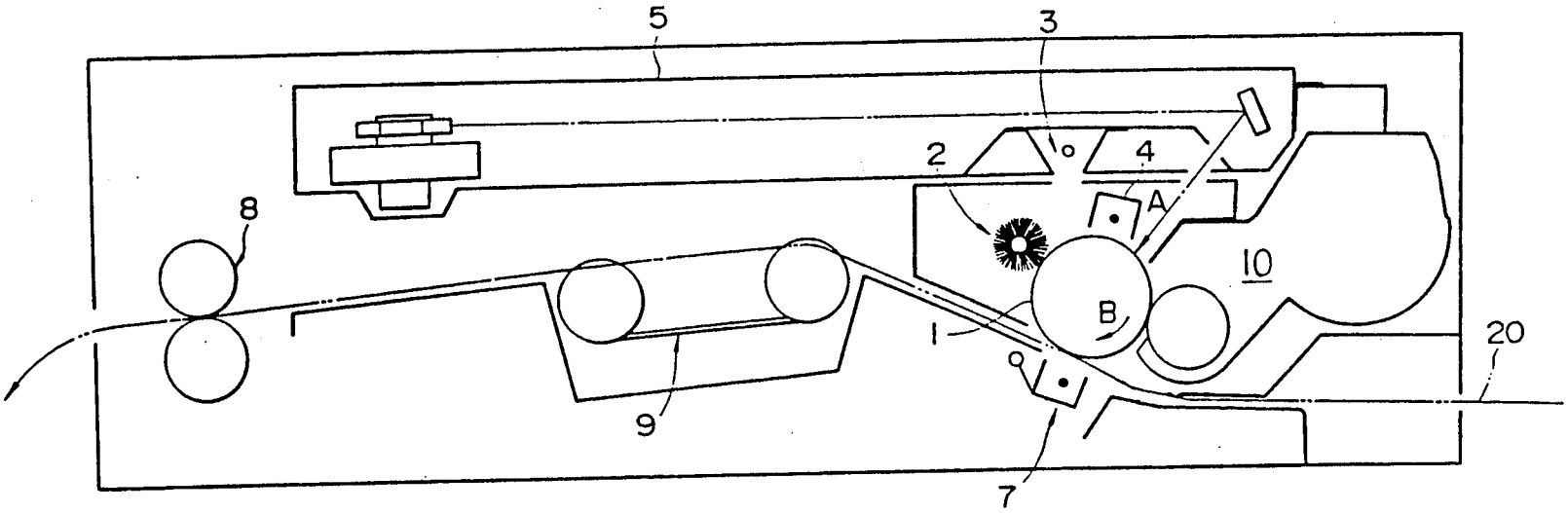
FIG. 1 is a schematic arrangement of a laser beam printer employing a toner supplying mechanism according to the present invention.

Referring to the drawings of FIG. 1 through 5, an arrangement and an operation of an embodiment of the present invention will be described hereinafter.

FIG. 1 shows a schematic arrangement of a laser beam printer to which a development unit using a toner supplying mechanism according to the present invention can be attached. In this type of printer, a so-called continuous-form sheet 20 is utilized as a recording medium on which character and/or symbol information inputted from an external computer (not shown) and the like are printed through an electrophotographic system.

A toner cleaning unit 2, a discharging unit 3, a charging unit 4, a scanning optical system 5 for introducing a laser beam to a photoconductive drum 1 as indicated by an arrow "A", a development unit 10, and a transfer unit 7 are respectively disposed around the photoconductive drum 1 along a rotating direction thereof indicated by an arrow "B". Further, a fixing unit 8 is disposed at the downstream side of the photoconductive drum 1, and a tractor unit 9 through which the continuous-form sheet 20 is fed toward the fixing unit 8 is disposed as shown in FIG. 1.

As the photoconductive drum 1 is rotated along the "B" direction, a circumferential surface of the photoconductive drum 1 is evenly charged at the charging unit 4 with a predetermined polarity, and the surface is scanned by the laser beam from the scanning optical system 5 having been modulated by image information to be developed to form an electrostatic latent image, toner is adhered to the latent image to form a visible image corresponding to the latent image. The toner image is transferred onto the continuous-form sheet 20 at the transfer unit 7 and fixed at the fixing unit 8.

Figure 2:
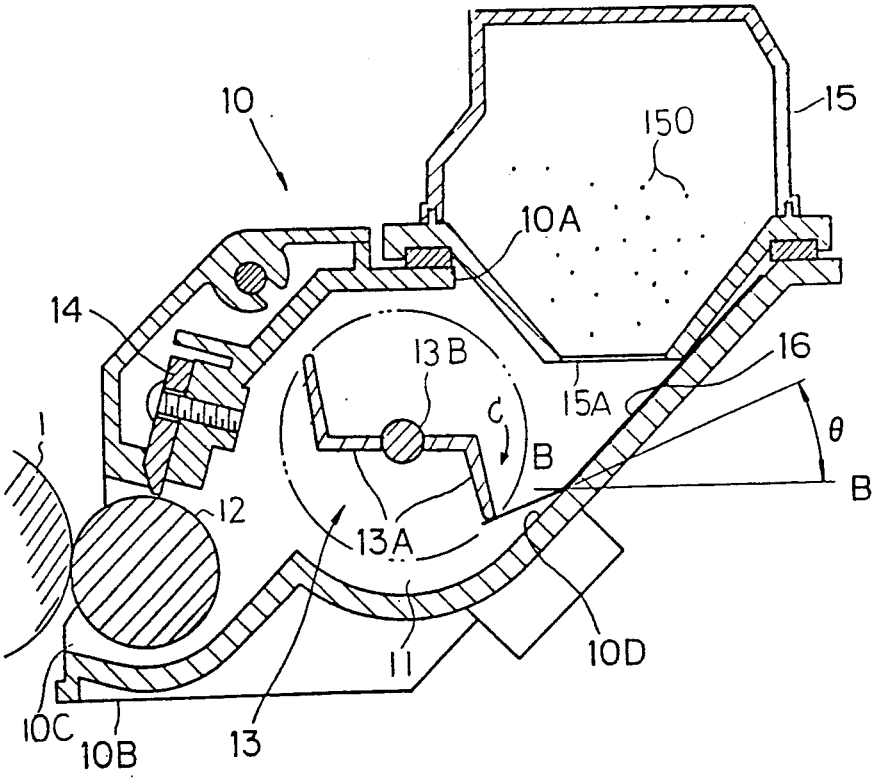
FIG. 2 is a sectional side view of a development unit employing a toner supplying mechanism according to the present invention.
Figure 3:
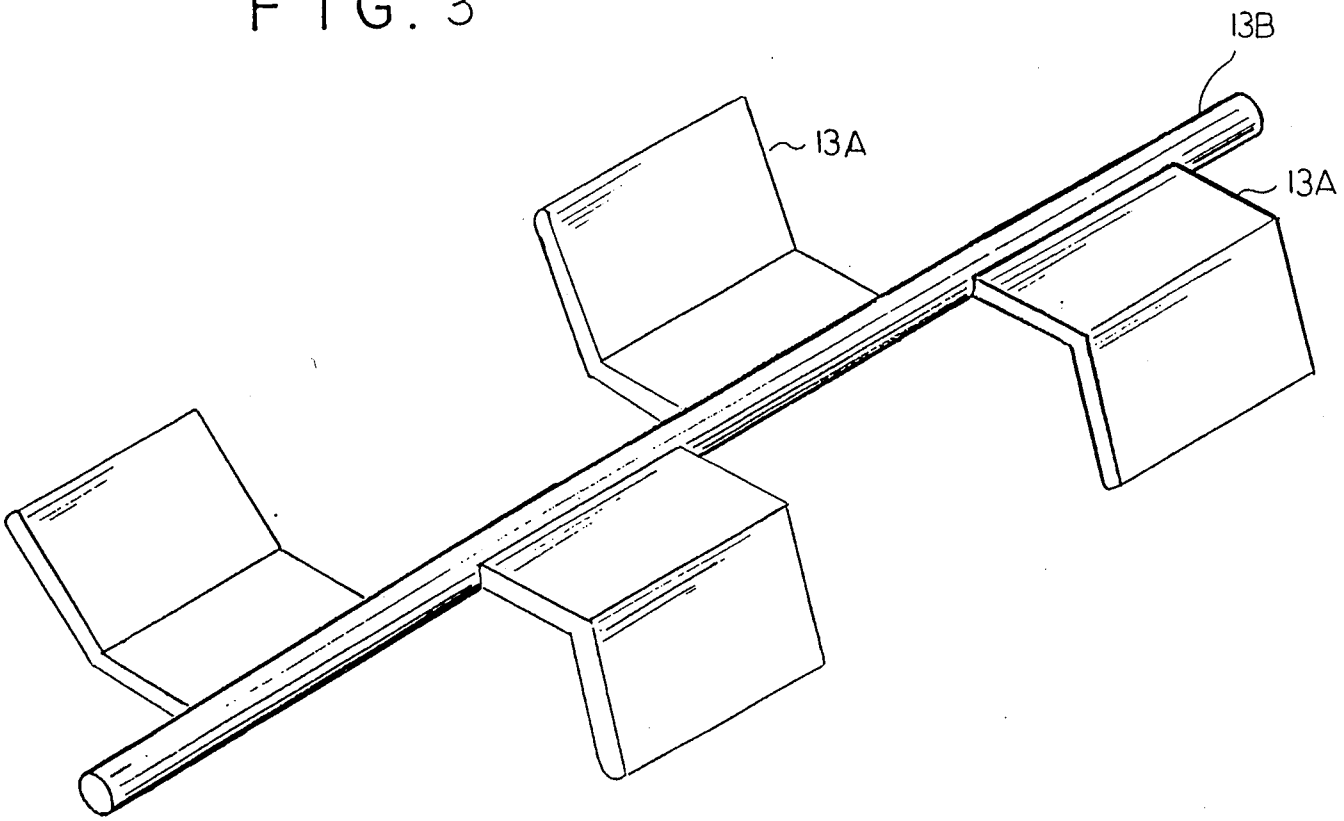
FIG. 3 is a perspective view of a toner scraper which is employable to the development unit shown in FIG. 2.

FIG. 2 shows a sectional side view of a development unit 10 employing a toner supplying mechanism according to the present invention, and FIG. 3 shows a perspective view of a toner scraper which is employable thereto. In this development unit 10, as shown in FIG. 2, a development roller 12 is provided at the downward position of a toner accommodating part 11. The development roller 12 is substantially formed in a cylindrical shape. At the opposite position of the development roller 12 about the toner accommodating part 11, i.e., the upper position of the toner accommodating part 11, there is provided a toner supplying opening 10A to which a toner cartridge 15 is to be detachably mounted through an attachment mechanism formed around the toner supplying opening 10A. After the toner cartridge 15 is mounted, a base seal 15A is removed and a multiplicity of toner particles 150 having been housed within the toner cartridge 15 is supplied to the toner accommodating part 11 and the toner cartridge 15 is used as a cover for preventing the toner particles from being scattered into the air.

In the central portion of the toner accommodating part 11, a toner scraper 13 is provided. As shown in FIG. 3, the toner scraper 13 comprises a plurality of pairs of arm members 13A which are connected to a shaft member 13B arranged to be rotated by a predetermined driving source such as a motor (not shown).

The development roller 12 is supported by a case 10B of the development unit 10 at both side edges by a pair of supporting members, (not shown) and arranged in such a manner that a part thereof is exposed toward the outside of the development unit 10 through an opening portion 10C. The toner particles are attracted to the development roller 12 by magnetic force generated by a magnet (not shown) provided within the development roller 12. The exposed portion of the development roller 12 is arranged to be contacted with the circumferential surface of the photoconductive drum 1 and the toner particles are adhered thereon. Numeral 14 indicates a blade member for regulating thickness of the toner particles accumulated on the circumferential surface of the development roller 12.

As the shaft 13B is rotated in a direction indicated by an arrow "C", the toner particles are scraped and fed toward the development roller 12 by the rotating arm member 13A.

At the lower side of the toner cartridge 15, an inner wall 10D is formed in an inclined state so that the toner particles are effectively supplied toward the toner scraper 13, and a sheet member 16 made by an elastic material, such as PET (Polyethlene terehutarate), is mounted on the inner wall 10D. In other words, the toner particles are primarily supplied to the sheet member 16 from the toner cartridge 15.

Figure 4:
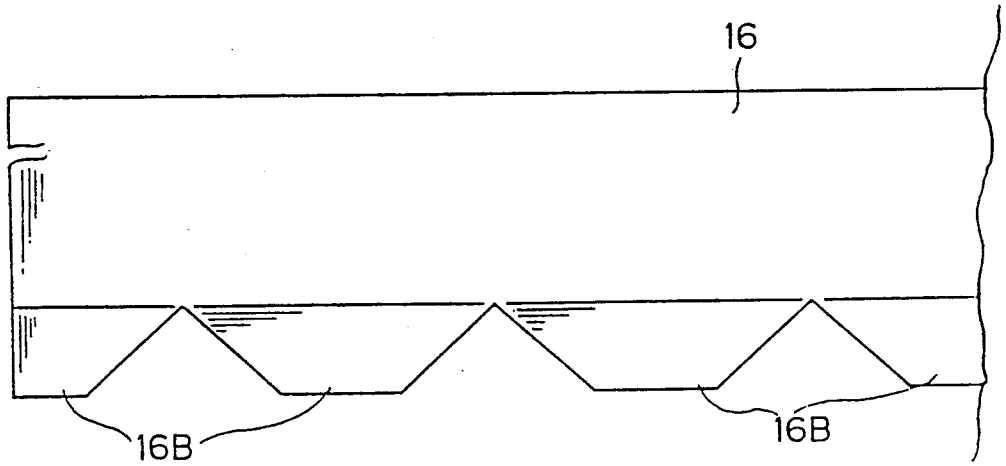
FIG. 4 is a plane view showing an elastic sheet member used in the toner supplying mechanism shown in FIG. 2.
Figure 5:
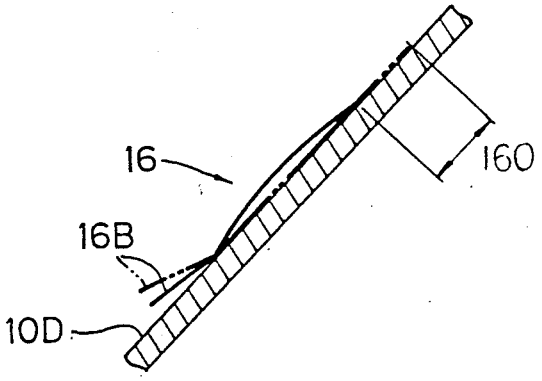
FIG. 5 is a partial enlarged view showing a development unit to which the elastic sheet member shown in FIG. 4 is attached.

FIG. 4 shows a plane view of the sheet member 16 and FIG. 5 shows an enlarged side view of the inclined inner surface 10D on which the sheet member 16 is mounted. As shown in FIG. 4, the sheet member 16 is arranged in such a manner that the lower edge portion along the inner wall 10D is slightly bent with a predetermined angle, further a plurality of portions thereof are tapered and arranged at predetermined lengths along a width direction of the sheet member 16.

The sheet member 16 is adhered on the inner wall 10D in such a manner that the bent portions 16B are downwardly directed and an upper predetermined portion 160 is adhered to the surface of the inner wall 10D by a predetermined well-known manner, such as welding.

In this above-described arrangement, an angle $\theta$ formed by the bent portions 16B and a horizontal line indicated by the "B—B" line in FIG. 2 are arranged in such a manner that the bent portions 16B are downwardly directed. It may be considered that the angle $\theta$ is arranged to be "0" or slightly directed to an upward direction, however, it is preferable to downwardly bend the bent portions 16B.

Further, as indicated in FIG. 2, predetermined edge portions of the bent portions 16B are arranged so as to be contacted with one of the moving arm members 13A. In other words, each of the bent portions 16B are flipped by one of the arm members 13A as the shaft 13B is rotated. When the bent portions 16B are contacted with the arm members 13A, the sheet member 16 is wrinkled as indicated by a solid line of FIG. 5, and returned to a free state indicated by a two dashed line with a damped oscillation when the arm members 13A separate from the bent portions 16B. Therefore, with the damped oscillation, the toner particles on the sheet member 16 slide downwardly and are toward the toner scraper 13. If the bent angle of the bent portions 16B is either upwardly or horizontally formed, the toner particles on the sheet member 16 do not slide downwardly when the arm members 13A are contacted with the bent portions 16B. The toner particles fall when the arm members 13A are separated form the bent portion 16B, i.e., when the bent portions 16B are flipped by the arm members 13A. However, some toner particles at the bent portion 16B remain without falling. Accordingly, it is preferable to downwardly bend the bent portions 16B.

It is possible to freely designate the bent angle of the bent portion 16B and thickness of the plate 16, in so far as the above-described operation can be definitely executed, that is, each of the bent portions 16B are located within the rotation locus of the arm members 13A and flipped thereby, and further the bent portions 16B are oscillated by the elastic force thereof. Further, by employing a conductive material for the sheet member 16 which is grounded, it becomes possible to prevent the toner particles from being attracted thereto by electrostatic force.

In FIG. 3, two kinds of connecting angles of arm members are represented. However, it may be arranged to designate more kinds of connecting angles. Therefore, it becomes possible to flip the sheet member 16 in the desired manner.

As described above, it becomes possible to effectively supply the toner particles toward the toner scraper and feed them toward the development roller with a simple structure.

The present disclosure relates to subject matter contained in Japanese Patent Application No. HEI 02-94423 (filed on Apr. 10, 1990) which is expressly incorporated by reference in its entirety.

What is claimed is:

1. A development unit, adapted to be positioned in an imaging apparatus for forming a toner image, comprising a development roller for attracting toner particles thereto and subsequently transferring said particles onto a circumferential surface of a predetermined material, a toner cartridge member provided at an upper side of said development roller for housing a multiplicity of toner particles to be supplied toward said development roller through an inclined inner wall of said development unit, and a scraper member, having at least one rotating arm member on a predetermined shaft member, located between said development roller and said toner cartridge for scraping said toner particles on said inner wall and feeding them toward said development roller;

said development unit further comprising an elastic sheet member, located on said inclined inner wall and having upper and lower edge portions, said lower edge portion being arranged to be flipped by said rotating arm member, while said upper edge portion is fixed to said inclined inner wall.

2. The development unit according to claim 1, wherein said predetermined material comprises a rotating drum member on which a photoconductive material layer is provided.

3. The development unit according to claim 1, wherein said scraper member further includes a plurality of arm members on said predetermined shaft member.

4. The development unit according to claim 1, wherein said lower edge portion of said sheet member is bent so as to be separated from said inclined inner wall and directed to said rotating arm member.

5. The development unit according to claim 4, wherein said bent portion is downwardly inclined, with respect to horizontal, with a predetermined angle.

6. A particle supplying acceleration mechanism, adapted to be positioned in a device in which a multiplicity of particles are supplied from a predetermined position to another predetermined position located at lower side of said predetermined position through an inclined inner wall of said device, for further supplying said particles having been supplied from said predetermined position toward said another predetermined position, comprising a scraper member, including at least one rotating arm member, located between said predetermined position and said another predetermined position;

said particle supplying acceleration mechanism further comprising an elastic sheet member, located on said inclined inner wall, whose lower edge portion is arranged to be flipped by said rotating arm member, while upper edge portion is fixed to said inclined inner wall.

7. The particle supplying acceleration mechanism according to claim 6, wherein said lower edge portion is bent so as to be separated from said inclined inner wall and directed to said rotating arm member.

8. The particle supplying acceleration mechanism according to claim 6, wherein said bent portion is downwardly inclined, with respect to horizontal, with a predetermined angle.

9. The particle supplying acceleration mechanism according to claim 6, wherein said scraper member further includes a plurality of arm members on said predetermined shaft member.

* * * * *